US006923925B2

(12) United States Patent
Chang et al.

(10) Patent No.: US 6,923,925 B2
(45) Date of Patent: Aug. 2, 2005

(54) PROCESS OF MAKING POLY (TRIMETHYLENE DICARBOXYLATE) FIBERS

(75) Inventors: Jing C. Chang, Boothwyn, PA (US); Joseph V. Kurian, Hockessin, DE (US); Shekhar Subramoney, Hockessin, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 130 days.

(21) Appl. No.: 10/183,710

(22) Filed: Jun. 27, 2002

(65) Prior Publication Data

US 2004/0001950 A1 Jan. 1, 2004

(51) Int. Cl.[7] ..... D01D 5/34; D01F 8/14; D02G 1/02; D02G 3/02; D02G 3/24

(52) U.S. Cl. ..... 264/103; 57/284; 264/143; 264/168; 264/172.13; 264/210.5; 264/210.8; 264/211; 264/211.12

(58) Field of Search ..... 264/168, 103, 264/143, 172.13, 210.5, 210.8, 211, 211.12; 57/284

(56) References Cited

U.S. PATENT DOCUMENTS

| | | | |
|---|---|---|---|
| 3,718,534 | A | 2/1973 | Okamoto et al. |
| 4,307,565 | A | 12/1981 | Sasaki et al. |
| 4,410,473 | A | 10/1983 | Iohara et al. |
| 4,442,057 | A | 4/1984 | Brody |
| 4,454,196 | A | 6/1984 | Iohara et al. |
| 4,475,330 | A | 10/1984 | Kimura et al. |
| 4,518,744 | A | 5/1985 | Brody |
| 4,609,710 | A | 9/1986 | Iohara et al. |
| 5,340,909 | A | 8/1994 | Doerr et al. |
| 5,645,782 | A | 7/1997 | Howell et al. |
| 5,782,935 | A | 7/1998 | Hirt et al. |
| 5,962,131 | A | 10/1999 | Schwinde et al. |
| 5,993,712 | A | 11/1999 | Wandel et al. |
| 6,136,435 | A | 10/2000 | Yoshimura et al. |
| 6,235,389 | B1 | 5/2001 | Schwarz et al. |
| 6,245,844 | B1 | 6/2001 | Kurian et al. |
| 6,287,688 | B1 | 9/2001 | Howell et al. |
| 6,312,805 | B1 | 11/2001 | Sun |
| 6,333,106 | B2 | 12/2001 | Howell et al. |
| 2001/0030371 | A1 | 10/2001 | Howell et al. |
| 2001/0030377 | A1 | 10/2001 | Howell et al. |
| 2001/0033929 | A1 | 10/2001 | Howell et al. |
| 2002/0014718 | A1 | 2/2002 | Klein et al. |
| 2002/0017735 | A1 | 2/2002 | Schwind et al. |

FOREIGN PATENT DOCUMENTS

| | | | |
|---|---|---|---|
| EP | 0154425 | B1 | 10/1990 |
| EP | 1167594 | A1 | 2/2002 |
| JP | 56-91013 | A | 7/1981 |
| JP | 57-61716 | A | 4/1982 |
| JP | 57-193536 | A | 11/1982 |
| JP | 62-021817 | A | 1/1987 |
| JP | 6-345923 | A | 12/1994 |
| JP | 11-189925 | A | 7/1999 |
| JP | 11-286596 | A | 10/1999 |
| KR | 051331 | A | 9/1998 |
| KR | 2002-0007569 | | 1/2002 |
| WO | WO 01/34693 | A2 | 5/2001 |
| WO | WO 02/22925 | A1 | 3/2002 |
| WO | WO 02/22927 | A1 | 3/2002 |

OTHER PUBLICATIONS

English Translation of Japanese Patent Abstract (Pub. No. 62–021817).

English Translation of Japanese Patent Abstract (Pub. No. 11–269719; Date: May 10, 1999: Patentee: Teijin Ltd.).

*Primary Examiner*—Leo B. Tentoni
(74) *Attorney, Agent, or Firm*—Mark D. Kuller

(57) ABSTRACT

A process for preparing poly(trimethylene dicarboxylate) multifilament yarns and monofilaments. One process for preparing poly(trimethylene dicarboxylate) multifilament yarns includes (a) providing a polymer blend including poly(trimethylene dicarboxylate) and about 0.1 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn including poly (trimethylene dicarboxylate) multiconstituent filaments containing styrene polymer dispersed throughout the filaments. Another process includes spinning at a speed of at least 3,000 m/m and processing a blend including poly (trimethylene dicarboxylate) to form partially oriented poly (trimethylene dicarboxylate) multifilament yarn. A poly (trimethylene terephthalate) yarn including poly (trimethylene terephthalate) multiconstituent filament containing styrene polymer dispersed throughout the multiconstituent filament. The invention is also directed to uses of the filament yarns and monofilament.

51 Claims, 2 Drawing Sheets

PROCESS OF MAKING POLY (TRIMETHYLENE DICARBOXYLATE) FIBERS

FIELD OF THE INVENTION

This invention relates to a process for spinning poly (trimethylene dicarboxylate) fibers, the resultant fibers, and their use.

BACKGROUND OF THE INVENTION

Poly(trimethylene terephthalate) (also referred to as "3GT" or "PTT") has recently received much attention as a polymer for use in textiles, flooring, packaging and other end uses. Textile and flooring fibers have excellent physical and chemical properties.

Textured polyester yarns, prepared from partially oriented polyester yarns or spun drawn yarns, are used in many textile applications, such as knit and woven fabrics (e.g., as the yarn for the entire fabric, the warp, weft or fill, or as one of two or more yarns in a blend, for instance, with cotton, wool, rayon, acetate, other polyesters, spandex and/or combinations thereof, etc.) for apparel and upholstery (e.g., furniture and automotive). Poly(ethylene terephthalate) textured yarns are commonly used for this purpose. Howell et al., in U.S. Pat. No. 6,287,688 (which is incorporated herein by reference), have described preparing textured poly (trimethylene terephthalate) yarns and their benefits. The resultant yarns have increased stretch, luxurious bulk and improved hand, as compared to poly(ethylene terephthalate) yarns. Howell et al. describe preparing stable partially oriented poly(trimethylene terephthalate) yarns in a process with a spinning speed of up to 2600 m/m, and it has been desired to spin at higher rates.

Preparing stable partially oriented poly(trimethylene terephthalate) yarns at high speeds using poly(ethylene terephthalate) conditions has not worked well. After spinning, a partially oriented yarn is typically wound onto a tube, or package, and the yarn packages are then stored or sold for use as a feed yarn in later processing operations such as drawing or draw-texturing. A partially oriented yarn package is not useable in subsequent drawing or draw-texturing processes if the yarn or the package itself are damaged due to aging of the yarns or other damage caused during warehousing or transportation of the yarn package.

Stable partially oriented poly(ethylene terephthalate) yarns are typically spun at speeds of about 3,500 yards per minute ("ypm") (3,200 meters per minute ("m/m")). Since they typically do not age very rapidly, they remain suitable for downstream drawing or draw-texturing operations. In the past, attempts to make stable partially oriented poly (trimethylene terephthalate) yarns using a spinning speed in this same range have failed. The resulting partially oriented poly(trimethylene terephthalate) yarns have been found to contract up to about 25% as they crystallize with aging over time. In extreme case, the contraction is so great that the tube is physically damaged by the contraction forces of the yarn. In more common cases, the contraction renders the partially oriented poly(trimethylene terephthalate) yarns unfit for use in drawing or draw-texturing operations. In such cases, the package becomes so tightly wound that the yarn easily breaks as it is unwound from the package.

Spinning partially oriented poly(trimethylene terephthalate) yarns at slower speeds using equipment originally designed for partially oriented poly(ethylene terephthalate) yarns is inefficient. It is also problematic since the spinning and winding equipment is designed to run at higher speeds than those presently used for making poly (trimethylene terephthalate) yarns.

Spun drawn yarns are also used to make textured yarns, and there is also a desire to prepare spun drawn yarns at higher speeds.

It is also very desirable that the practitioner be able to make textured poly(trimethylene terephthalate) yarns from partially oriented and spun drawn poly(trimethylene terephthalate) yarns prepared at high speeds using the same or similar conditions to those produced at lower speeds. Thus, these yarns should have the same or similar elongations and tenacities.

Poly(trimethylene terephthalate) filaments and yarns have also been prepared for other purposes. For instance, bulked continuous filament ("BCF") yarns, their manufacture, and their use in flooring, are described in U.S. Pat. Nos. 5,645,782, 5,662,980, and 6,242,091, which are hereby incorporated by reference. Fine denier yarns are described in U.S. Patent Publication Nos. 2001/30377 and 2001/53442, which are incorporated herein by reference, and direct use yarns are described in U.S. Patent Publication No. 2001/33929, which is incorporated herein by reference. Staple fibers can be made from multifilament yarns as described in WO 02/22925 and WO 02/22927, which are incorporated by reference. Spinning these yarns, as well as other poly (trimethylene terephthalate) yarns and filaments, at higher speeds can be advantageous. Therefore, the ability to spin poly(trimethylene terephthalate) yarns and fibers at higher speeds is desired. It is also desired that the practitioner be able to use the resultant yarns under the same conditions as yarns prepared at slower speeds.

Use of various additives to obtain benefits in spinning or other processing steps has been described in many patents. For instance, U.S. Pat. No. 4,475,330, which is incorporated herein by reference, discloses a high twist polyester multifilament yarn made from polyester filaments consisting essentially of (a) a copolymer of two or more monomers selected from the group consisting of ethylene terephthalate, trimethylene terephthalate and tetramethylene, and/or (b) a blend of two or more polymers of ethylene terephthalate, trimethylene terephthalate and tetramethylene terephthalate. The patent states that a woven or knitted crepe fabric obtained by employing such a high twist yarn has a desirable pebble configuration. The preferred polyester is comprised of 20% to 90% by weight of ethylene terephthalate units, and 80% to 10% by weight of trimethylene units and/or tetramethylene units. The examples show blends comprising 50 weight % poly(ethylene terephthalate), 25 weight % poly(tetramethylene terephthalate) and 25 weight % poly (trimethylene terephthalate). In addition, Example 6 describes polymer blends comprising 95 to 10% weight % poly(ethylene terephthalate) and 5 to 90 weight % poly (trimethylene terephthalate). This patent describes use of 3 to 15% of non-crystalline polymer, preferably styrene polymers or methacrylate polymers, to impart higher twist setting ability. Example 7 shows use of polystyrene with poly(ethylene terephthalate), poly(tetramethylene terephthalate), and blends thereof.

U.S. Pat. Nos. 4,454,196 and 4,410,473, which are incorporated herein by reference, describe a polyester multifilament yarn consisting essentially of filament groups (I) and (II). Filament group (I) is composed of polyester selected from the group poly(ethylene terephthalate), poly (trimethylene terephthalate) and poly(tetramethylene terephthalate), and/or a blend and/or copolymer comprising at least two members selected from these polyesters. Filament group (II) is composed of a substrate composed of (a) a polyester selected from the group poly(ethylene terephthalate), poly(trimethylene terephthalate) and poly (tetramethylene terephthalate), and/or a blend and/or copolymer comprising at least two members selected from these polyesters, and (b) 0.4 to 8 weight % of at least one polymer selected from the group consisting of styrene type polymers, methacrylate type polymers and acrylate type polymers. The filaments can be extruded from different spinnerets, but are preferably extruded from the same spinneret. It is preferred that the filaments be blended and then interlaced so as to intermingle them, and then subjected to drawing or draw-texturing. The Examples show preparation of filaments of type (II) from poly(ethylene terephthalate) and polymethylmethacrylate (Example 1) and polystyrene (Example 3), and poly(tetramethylene terephthalate) and polyethylacrylate (Example 4). Poly(trimethylene terephthalate) was not used in the examples.

JP 56-091013, which is incorporated herein by reference, describes an undrawn polyester yarn containing 0.5 to 10% by weight of a styrenic polymer having a degree of polymerization of 20 or higher. The fibers elongation is increased. The polyesters mentioned are poly(ethylene terephthalate), poly(tetramethylene terephthalate), polycyclohexane dimethylene terephthalate and polyethylene-2,6-naphthalene dicarboxylate.

JP 11-189925, which is incorporated herein by reference, describes the manufacture of sheath-core fibers comprising poly(trimethylene terephthalate) as the sheath component and a polymer blend comprising 0.1 to 10 weight %, based on the total weight of the fiber, polystyrene-based polymer. According to this application, processes to suppress molecular orientation using added low softening point polymers such as polystyrene did not work. (Reference is made to JP 56-091013 and other patent applications.) It states that the low melting point polymer present on the surface layer sometimes causes melt fusion when subjected to a treatment such as false-twisting (also known as "texturing"). Other problems mentioned included cloudiness, dye irregularities, blend irregularities and yarn breakage. According to this application, the core contains polystyrene and the sheath does not. Example 1 describes preparation of a fiber with a sheath of poly(trimethylene terephthalate) and a core of a blend of polystyrene and poly(trimethylene terephthalate), with a total of 4.5% of polystyrene by weight of the fiber.

It is desired to increase productivity in the manufacture of poly(trimethylene terephthalate) yarns, particularly partially oriented yarns, spun drawn yarns, and bulked continuous filament yarns, and in the manufacture of staple fibers, by using a high speed spinning process, without deterioration of the filament and yarn properties. It is further desired for these yarns to be useful in preparing products, such as textured yarns, fabrics and carpets, under the same or similar conditions to those used for poly(trimethylene terephthalate) yarns prepared at slower speeds.

SUMMARY OF THE INVENTION

This invention is directed to a process for preparing poly(trimethylene dicarboxylate) multifilament yarn comprising (a) providing a polymer blend comprising poly (trimethylene dicarboxylate) and about 0.1 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly (trimethylene dicarboxylate) multiconstituent filaments containing styrene polymer dispersed throughout the filaments.

Preferably, the poly(trimethylene dicarboxylate) is selected from the group consisting of poly(trimethylene arylate)s and mixtures thereof, and is more preferably poly (trimethylene terephthalate).

Preferably the blend comprises about 90 to about 99.9 weight % of the poly(trimethylene arylate) and about 10 to about 0.1 weight % of the styrene polymer, by weight of the polymer in the polymer blend.

In another preferred embodiment, the polymer blend comprises about 70 to about 99.9 weight % of the poly (trimethylene terephthalate), about 5 to about 0.5 weight % of the styrene polymer, by weight of the polymer in the polymer blend and, optionally, up to 29.5 weight % of other polyesters, by weight of polymer in the polymer blend.

Most preferably, the blend comprises about 2 to about 0.5% styrene polymer, by weight of the polymer in the polymer blend.

More preferably the blend comprises about 95 to about 99.5% of the poly(trimethylene terephthalate) and about 2 to about 0.5% of the styrene polymer, by weight of the polymer in the polymer blend.

Preferably the multiconstituent filaments are poly (trimethylene terephthalate) biconstituent filaments comprised of about 98 to about 99.5% poly(trimethylene terephthalate) and about 2 to about 0.5% styrene polymer, by weight of the polymer in the filaments.

Preferably the styrene polymer is selected from the group consisting of polystyrene, alkyl or aryl substituted polystyrenes and styrene multicomponent polymers.

More preferably the styrene polymer is selected from the group consisting of polystyrene, alkyl or aryl substituted polystyrenes prepared from α-methylstyrene, p-methoxystyrene, vinyltoluene, halostyrene and dihalostyrene (preferably chlorostyrene and dichlorostyrene), styrene-butadiene copolymers and blends, styrene-acrylonitrile copolymers and blends, styrene-acrylonitrile-butadiene terpolymers and blends, styrene-butadiene-styrene terpolymers and blends, styrene-isoprene copolymers, terpolymers and blends, and blends and mixtures thereof. Even more preferably, the styrene polymer is selected from the group consisting of polystyrene, methyl, ethyl, propyl, methoxy, ethoxy, propoxy and chloro-substituted polystyrene, or styrene-butadiene copolymer, and blends and mixtures thereof. Yet more preferably, the styrene polymer is selected from the group consisting of polystyrene, α-methyl-polystyrene, and styrene-butadiene copolymers and blends thereof. Most preferably, the styrene polymer is polystyrene.

Preferably the styrene polymer number average molecular weight is at least about 50,000, more preferably at least about 75,000, even more preferably at least about 100,000, and most preferably at least about 120,000. The styrene polymer number average molecular weight is preferably up to about 300,000, more preferably up to about 200,000.

In preferred embodiments, the blend further comprises at least one selected from the group consisting of hexamethylene diamine, polyamides, delusterants, nucleating agents, heat stabilizers, viscosity boosters, optical brighteners, pigments, and antioxidants; however, it can be prepared without any of these items.

In one preferred embodiment, the multifilament yarn is partially oriented yarn. Preferably, the spinning comprises extruding the polymer blend through a spinneret at a spinning speed of at least about 3,000 m/m. In another preferred embodiment, the multifilament yarns comprise about 0.5 to about 2.5 dpf filaments and are spun at a spinning speed of at least about 2,500 m/m. Preferably, these processes comprise interlacing and winding the filaments. The partially oriented yarns can be used to prepare textured yarns. One preferred embodiment, for preparing poly(trimethylene terephthalate) multifilament textured yarn comprising poly (trimethylene terephthalate) multiconstituent filaments comprises (a) preparing a package of partially oriented poly (trimethylene terephthalate) multifilament yarn, (b) unwinding the yarn from the package, (c) drawing the multiconstituent filaments yarn to form a drawn yarn, (d) false-twist texturing the drawn yarn to form the textured yarn, and (e) winding the yarn onto a package.

In another preferred embodiment, the multifilament yarn is spun drawn yarn and the processing comprises drawing the filaments at a draw speed, as measured at the roller at the end of the draw step, of about 2,000 to about 8,000 meters/minute ("m/m"). Preferably the processing of the multiconstituent filaments into spun drawn poly(trimethylene terephthalate) multifilament yarn comprises drawing, annealing, interlacing and winding the filaments. One preferred process for preparing poly(trimethylene terephtbalate) multifilament textured yarn comprising poly (trimethylene terephthalate) multiconstituent filaments, comprises (a) preparing a package of spun drawn poly (trimethylene terephthalate) multifilament yarn, (b) unwinding the yarn from the package, (c) false-twist texturing the yarn to form the textured yarn, and (d) winding the textured yarn onto a package.

In yet another preferred embodiment, the multifilament yarn is bulked continuous filament yarn. Preferably, in this embodiment the processing comprises drawing, annealing, bulking, entangling (which can be carried out in one step with bulking or in a subsequent separate step), optionally relaxing, and winding the filaments.

Another preferred embodiment is directed to the process further comprises cutting the multifilament yarn into staple fibers.

Preferably, the dispersed styrene polymer has a mean cross-sectional size of less than about 1,000 nm, more preferably less than about 500 nm, even more preferably, less than about 200 nm, and most preferably less than about 100 nm.

Preferably the styrene polymer is highly dispersed throughout the filaments.

Preferably the styrene polymer is substantially uniformly dispersed throughout the filaments.

The invention is also directed to a poly(trimethylene terephthalate) yarn comprising poly(trimethylene terephthalate) multiconstituent filament containing styrene polymer dispersed throughout the multiconstituent filament, and to fabrics (e.g., nonwoven, woven or knitted fabrics) and carpets made from the yarns.

The invention is further directed to a process for preparing a poly(trimethylene dicarboxylate) monofilament comprising (a) providing a polymer blend comprising poly (trimethylene dicarboxylate) and about 0.1 to about 10 weight % styrene polymer, by weight of the polymer in the polymer blend, (b) spinning the polymer blend to form poly(trimethylene dicarboxylate) monofilament containing dispersed styrene polymer, and (c) processing the filament into poly(trimethylene dicarboxylate) multiconstituent monofilament comprising poly(trimethylene dicarboxylate) styrene polymer dispersed throughout.

The invention enables manufacture of filaments that can be used in subsequent processing operations under similar conditions to those used with yarns prepared at lower speeds. Consequently, the invention is directed to a process for preparing poly(trimethylene dicarboxylate) multifilament yarn, comprising spinning at a speed of at least 3,000 m/m and processing a blend comprising poly(trimethylene dicarboxylate) and about 0.1 to about 10 weight % of another polymer, by weight of the polymers in the polymer blend, to form poly(trimethylene dicarboxylate) multifilament yarn, wherein the poly(trimethylene dicarboxylate) multifilament yarn has an elongation and tenacity within 20% of the elongation and tenacity of a poly(trimethylene dicarboxylate) multifilament yarn that only differs from the poly(trimethylene dicarboxylate) multifilament yarn in that it does not contain the other polymer and which is prepared in the same manner except that it is spun at a speed of 2,500 m/m and processed at speeds corresponding to that spinning speed. Preferably the poly(trimethylene dicarboxylate) is selected from poly(trimethylene arylate)s, and more preferably it is poly(trimethylene terephthalate). Preferably the yarns are partially oriented yarns, preferably spun as described herein. This invention is also directed to other types of yarns described herein (e.g., spun drawn yarns and bulked continuous filament yarns) prepared with such results.

Other preferences are described below.

The invention enables the practitioner to increase productivity in the spinning of poly(trimethylene terephthalate) yarns, particularly partially oriented yarns, spun drawn yarns, bulked continuous filament yarns and staple fiber manufacture, by using a high spinning speed process. Surprisingly, the resultant yarns are useful in preparing products, such as textured yarns, fabrics and carpets, under the same or similar conditions to those used for poly (trimethylene terephthalate) yarns prepared at slower speeds. In addition, it has been found that the styrene polymer uniformly dispersed throughout the multiconstituent filaments, and can be prepared and used at high speeds, are stable, have good physical properties, and can be dyed uniformly. Other results are described below.

DETAILED DESCRIPTION OF THE INVENTION

Figure 1:
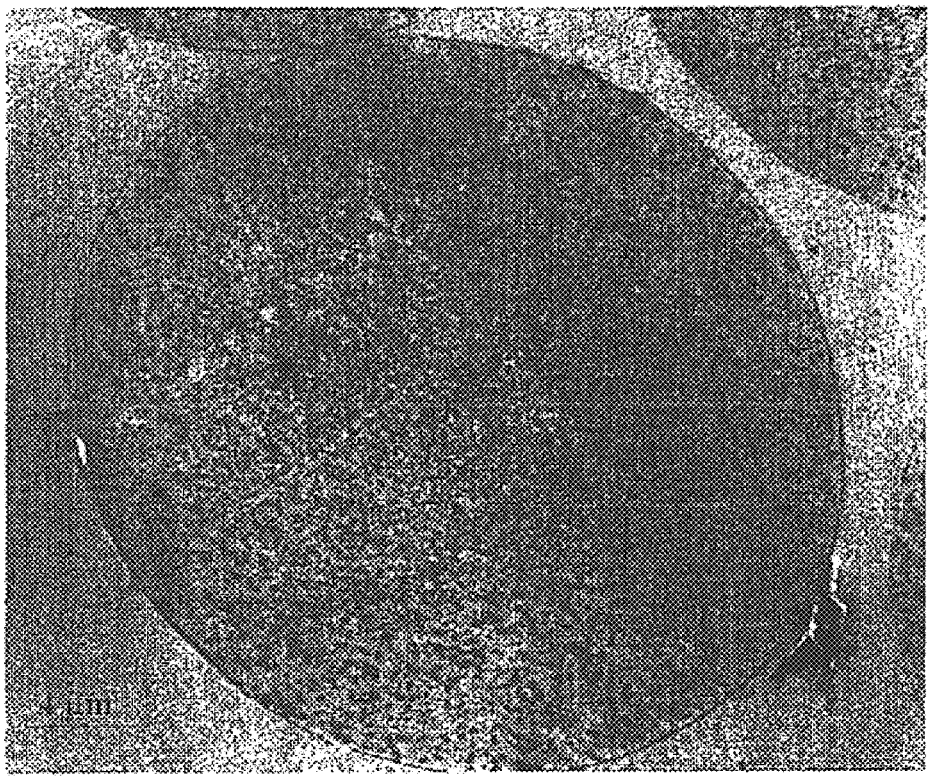
FIG. 1 is an electron micrograph showing a radial cross-section of a filament comprising poly(trimethylene terephthalate) and styrene polymer according to this invention.

A process has been developed to produce poly (trimethylene dicarboxylate) yarns, particularly partially oriented yarns, at high spin speeds. The advantages of the invention are obtained using a blend comprising poly (trimethylene dicarboxylate) and styrene polymer.

The preferred poly(trimethylene dicarboxylate)s are the poly(trimethylene arylate)s. Examples are poly(trimethylene terephthalate), poly(trimethylene naphthalate), poly (trimethylene isophthalate). Most preferred is poly (trimethylene terephthalate) and, for convenience, this document will refer to poly(trimethylene terephthalate), from which the person of ordinary skill in the art will readily recognize how to apply the invention to other poly (trimethylene dicarboxylates).

In the absence of an indication to the contrary, a reference to "poly(trimethylene terephthalate)" ("3GT" or "PTT"), is meant to encompass homopolymers and copolymers containing at least 70 mole % trimethylene terephthalate repeat units and polymer blends containing at least 70 mole % or the homopolymers or copolyesters. The preferred poly (trimethylene terephthalate)s contain at least 85 mole %, more preferably at least 90 mole %, even more preferably at least 95 or at least 98 mole %, and most preferably about 100 mole %, trimethylene terephthalate repeat units.

Examples of copolymers include copolyesters made using 3 or more reactants, each having two ester forming groups. For example, a copoly(trimethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 2–8 carbon atoms (other than 1,3-propanediol, for example, ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and aromatic ether glycols having 4–10 carbon atoms (for example, hydroquinone bis(2-hydroxyethyl) ether, or a poly (ethylene ether) glycol having a molecular weight below about 460, including diethyleneether glycol). The comonomer typically is present in the copolyester at a level in the range of about 0.5—about 15 mole %, and can be present in amounts up to 30 mole %.

The poly(trimethylene terephthalate) can contain minor amounts of other comonomers, and such comonomers are usually selected so that they do not have a significant adverse affect on properties. Such other comonomers include 5-sodium-sulfoisophthalate, for example, at a level in the range of about 0.2 to 5 mole %. Very small amounts of trifunctional comonomers, for example trimellitic acid, can be incorporated for viscosity control.

The poly(trimethylene terephthalate) can be blended with up to 30 mole percent of other polymers. Examples are polyesters prepared from other diols, such as those described above. The preferred poly(trimethylene terephthalate)s contain at least 85 mole %, more preferably at least 90 mole %, even more preferably at least 95 or at least 98 mole %, and most preferably about 100 mole %, poly(trimethylene terephthalate) polymer.

The intrinsic viscosity of the poly(trimethylene terephthalate) of the invention is at least about 0.70 dl/g, preferably at least about 0.80 dl/g, more preferably at least about 0.90 dl/g and most preferably at least about 1.0 dl/g. The intrinsic viscosity of the polyester composition of the invention are preferably up to about 2.0 dl/g, more preferably up to 1.5 dl/g, and most preferably up to about 1.2 dl/g.

The number average molecular weight (Mn) for poly (trimethylene terephthalate) is preferably at least about 10,000, more preferably at least about 20,000, and is preferably about 40,000 or less, more preferably about 25,000 or less. The preferred Mn depends on the poly(trimethylene terephthalate) used and any additives or modifiers present in the blend, as well as the properties of the styrene polymer.

Poly(trimethylene terephthalate) and preferred manufacturing techniques for making poly(trimethylene terephthalate) are described in U.S. Pat. Nos. 5,015,789, 5,276,201, 5,284,979, 5,334,778, 5,364,984, 5,364,987, 5,391,263, 5,434,239, 5,510454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,235,948, 6,245,844, 6,255,442, 6,277,289, 6,281,325, 6,312,805, 6,325,945, 6,331,264, 6,335,421, 6,350,895, and 6,353,062, EP 998 440, WO 00/14041 and 98/57913, H. L. Traub, "Synthese und textilchemische Eigenschaften des Poly-Trimethyleneterephthalats", Dissertation Universitat Stuttgart (1994), S. Schauhoff, "New Developments in the Production of Poly(trimethylene terephthalate) (PTT)", Man-Made Fiber Year Book (September 1996), and U.S. patent application Ser. No. 10/057,497(now U.S. Pat. No. 6,538,076), all of which are incorporated herein by reference. Poly(trimethylene terephthalate)s useful as the polyester of this invention are commercially available from E.I. du Pont de Nemours and Company, Wilmington, Del., under the trademark Sorona.

By "styrene polymer" is meant polystyrene and its derivatives. Preferably the styrene polymer is selected from the group consisting of polystyrene, alkyl or aryl substituted polystyrenes and styrene multicomponent polymers. Here, "multicomponent" includes copolymers, terpolymers, tetrapolymers, etc., and blends.

More preferably the styrene polymer is selected from the group consisting of polystyrene, alkyl or aryl substituted polystyrenes prepared from α-methylstyrene, p-methoxystyrene, vinyltoluene, halostyrene and dihalostyrene (preferably chlorostyrene and dichlorostyrene), styrene-butadiene copolymers and blends, styrene-acrylonitrile copolymers and blends, styrene-acrylonitrile-butadiene terpolymers and blends, styrene-butadiene-styrene terpolymers and blends, styrene-isoprene copolymers, terpolymers and blends, and blends and mixtures thereof. Even more preferably, the styrene polymer is selected from the group consisting of polystyrene, methyl, ethyl, propyl, methoxy, ethoxy, propoxy and chloro-substituted polystyrene, or styrene-butadiene copolymer, and blends and mixtures thereof. Yet more preferably, the styrene polymer is selected from the group consisting of polystyrene, α-methyl-polystyrene, and styrene-butadiene copolymers and blends thereof. Most preferably, the styrene polymer is polystyrene.

The number average molecular weight of the styrene polymer is at least about 5,000, preferably at least 50,000, more preferably at least about 75,000, even more preferably at least about 100,000 and most preferably at least about 120,000. The number average molecular weight of the styrene polymer is preferably up to about 300,000, more preferably up to about 200,000 and most preferably up to about 150,000.

Useful polystyrenes can be isotactic, atactic, or syndiotactic, and with high molecular weight polystyrenes atactic is preferred. Styrene polymers useful in this invention are commercially available from many suppliers including Dow Chemical Co. (Midland, Mich.), BASF (Mount Olive, N.J.) and Sigma-Aldrich (Saint Louis, Mo.).

Preferably poly(trimethylene terephthalate) and the styrene polymer are melt blended and, then, extruded and cut into pellets. ("Pellets" is used generically in this regard, and is used regardless of shape so that it is used to include products sometimes called "chips", "flakes", etc.) The pellets are then remelted and extruded into filaments. The term "mixture" is used to refer to the pellets prior remelting and the term "blend" is used to refer to them once they have been remelted. In considering the discussion of the relative weights of poly(trimethylene terephthalate), styrene polymer and other items described herein the same percentages apply to both the mixture and blend, although it will readily be recognized that various methods of preparing filaments can entail items being added to the mixture or blend, and therefore in some facilities the weight percentages can vary, but the ratio of poly(trimethylene terephthalate):styrene polymer should remain the same. For convenience, reference herein will be to the amount of polymer in the blend except where the specific reference is to the mixture before remelt.

The polymer blend comprises poly(trimethylene terephthalate) and a styrene polymer. In some cases these will be the only two items in the blend and they will total 100 weight %. However, in many instances the blend will have other ingredients, such as other polymers, additives, etc., and thus the total of the poly(trimethylene terephthalate) and polystyrene will not be 100 weight %.

The polymer blend preferably comprises at least about 70%, more preferably at least about 80%, even more preferably at least 85%, more preferably at least about 90%, most preferably at least about 95%, and in some cases even more preferably at least 98% of poly(trimethylene terephthalate) (by weight of the polymer in the polymer blend). The blend preferably contains up to about 99.9% of poly(trimethylene terephthalate).

The polymer blend preferably comprises at least about 0.1%, more preferably at least about 0.5%, of styrene polymer, by weight of the polymer in the polymer blend. The blend preferably comprises up to about 10%, more preferably up to about 5%, even more preferably up to about 2%, and most preferably up to about 1.5%, of a styrene polymer, by weight of the polymer in the polymer blend. In many instances, preferred is about 0.8% to about 1% styrene polymer, by weight of the polymer in the polymer blend. Reference to styrene polymer means at least one styrene polymer, as two or more styrene polymers can be used, and the amount referred to is an indication of the total amount of styrene polymer(s) used in the polymer blend.

The poly(trimethylene terephthalate) can also be an acid-dyeable polyester composition as described in U.S. patent application Ser. No. 09/708,209, filed Nov. 8, 2000 (now U.S. Pat. No. 6,576,340) (corresponding to WO 01/34693) or Ser. No. 09/938,760, filed Aug. 24, 2002 (published as U.S. 2003-0083441 A1), both of which are incorporated herein by reference. The poly(trimethylene terephthalate)s of U.S. patent application Ser. No. 09/708,209 comprise a secondary amine or secondary amine salt in an amount effective to promote acid-dyeability of the acid dyeable and acid dyed polyester compositions. Preferably, the secondary amine unit is present in the polymer composition in an amount of at least about 0.5 mole %, more preferably at least 1 mole %. The secondary amine unit is present in the polymer composition in an amount preferably of about 15 mole % or less, more preferably about 10 mole % or less, and most preferably 5 mole % or less, based on the weight of the composition. The acid-dyeable poly(trimethylene terephthalate) compositions of U.S. patent application Ser. No. 09/938,760 comprise poly(trimethylene terephthalate) and a polymeric additive based on a tertiary amine. The polymeric additive is prepared from (i) triamine containing secondary amine or secondary amine salt unit(s) and (ii) one or more other monomer and/or polymer units. One preferred polymeric additive comprises polyamide selected from the group consisting of poly-imino-bisalkylene-terephthalamide, -isophthalamide and -1,6-naphthalamide, and salts thereof. The poly(trimethylene terephthalate) useful in this invention can also cationically dyeable or dyed composition such as those described in U.S. Pat. No. 6,312,805, granted Nov. 6, 2001, which is incorporated herein by reference, and dyed or dye-containing compositions.

Other polymeric additives can be added to the poly (trimethylene terephthalate), styrene polymer, polymer blend, etc., to improve strength, to facilitate post extrusion processing or provide other benefits. For example, hexamethylene diamine can be added in minor amounts of about 0.5 to about 5 mole % to add strength and processability to the acid dyeable polyester compositions of the invention. Polyamides such as Nylon 6 or Nylon 6-6 can be added in minor amounts of about 0.5 to about 5 mole % to add strength and processability to the acid-dyeable polyester compositions of the invention. A nucleating agent, preferably 0.005 to 2 weight % of a mono-sodium salt of a dicarboxylic acid selected from the group consisting of monosodium terephthalate, mono sodium naphthalene dicarboxylate and mono sodium isophthalate, as a nucleating agent, can be added as described in U.S. Pat. No. 6,245,844, which is incorporated herein by reference.

The poly(trimethylene terephthalate), styrene polymer, mixture or blend, etc., can, if desired, contain additives, e.g., delusterants, nucleating agents, heat stabilizers, viscosity boosters, optical brighteners, pigments, and antioxidants. $TiO_2$ or other pigments can be added to the poly (trimethylene terephthalate), the blend, or in fiber manufacture. (See, e.g., U.S. Pat. Nos. 3,671,379, 5,798,433 and 5,340,909, EP 699 700 and 847 960, and WO 00/26301, which are incorporated herein by reference.)

The polymer blend can be provided by any known technique, including physical blends and melt blends. Preferably the poly(trimethylene terephthalate) and styrene polymer are melt blended and compounded. More specifically, poly(trimethylene terephthalate) and styrene polymer are mixed and heated at a temperature sufficient to form a blend, and upon cooling, the blend is formed into a shaped article, such as pellets. The poly(trimethylene terephthalate) and polystyrene can be formed into a blend in many different ways. For instance, they can be (a) heated and mixed simultaneously, (b) pre-mixed in a separate apparatus before heating, or (c) heated and then mixed. As an example, the polymer blend can be made by transfer line injection. The mixing, heating and forming can be carried out by conventional equipment designed for that purpose such as extruders, Banbury mixers or the like. The temperature should be above the melting points of each component but below the lowest decomposition temperature, and accordingly must be adjusted for any particular composition of poly(trimethylene terephthalate) and polystyrene. Temperature is typically in the range of about 200° C. to about 270° C., most preferably at least about 250° C. and preferably up to about 260° C., depending on the particular polystyrene composition of the invention.

By "multiconstituent filament" is meant a filament formed from at least two polymers, one of which forms a continuous phase and the others being in one or more discontinuous phases dispersed throughout the fiber, wherein the at least two polymers are extruded from the same extruder as a blend. The styrene polymer(s) form a discontinuous phase and is highly dispersed throughout the filaments. The styrene polymer can be seen to be substantially uniformly dispersed throughout the fibers. "Biconstituent" is used to refer to the case where the only polymer phases are the poly (trimethylene terephthalate) and styrene polymer. Specifically excluded from this definition are bicomponent and multicomponent fibers, such as sheath core or side-by-side fibers made of two different types of polymers or two of the same polymer having different characteristics in each region. This definition does not exclude other polymers being dispersed in the fiber, and additives and ingredients being present.

The styrene polymer is highly dispersed throughout the poly(trimethylene terephthalate) polymer matrix. Preferably, the dispersed styrene polymer has a mean cross-sectional size of less than about 1,000 nm, more preferably less than about 500 mn, even more preferably less than about 200 nm and most preferably less than about 100 nm, and the cross-section can be as small as about 1 nm. By "cross-sectional size", reference is made to the size when measured from a radial image of a filament, such as shown in FIG. 1.

Partially oriented yarns of poly(trimethylene terephthalate) are described in U.S. Pat. Nos. 6,287,688 and 6,333,106, and U.S. Patent Publication No. 2001/30378, all of which are incorporated herein by reference. The basic steps of manufacturing partially oriented yarns including spinning, interlacing and winding poly(trimethylene terephthalate) filaments are described therein. This invention can be practiced using those steps or other steps conventionally used for making partially oriented polyester yarns; however, it provides the advantage of carrying out the process at higher speeds.

Preferably, prior to spinning the blend is heated to a temperature above the melting point of each the poly (trimethylene terephthalate) and styrene polymer, and extruding the blend through a spinneret and at a temperature of about 235 to about 295° C., preferably at least about 250° C. and preferably up to about 290° C., most preferably up to about 270° C. Higher temperatures are useful with low residence time.

The partially oriented yarns are multifilament yarns. The yarns (also known as "bundles") preferably comprise at least about 10 and even more preferably at least about 25 filaments, and typically can contain up to about 150 or more, preferably up to about 100, more preferably up to about 80 filaments. Yams containing 34, 48, 68 or 72 filaments are common. The yarns typically have a total denier of at least about 5, preferably at least about 20, preferably at least about 50, and up to about 1,500 or more, preferably up to about 250.

Filaments are preferably at least about 0.5 dpf, more preferably at least about 1 dpf, and up to about 10 or more dpf, more preferably up to about 7 dpf. Typical filaments are about 3 to 7 dpf, and fine filaments are about 0.5 to about 2.5 dpf.

Spin speeds can run from about 1,800 to about 8,000 or more meters/minute ("m/m"), and are preferably at least about 2,000 m/m, more preferably at least about 2,500 m/m, and most preferably at least about 3,000 m/m. One advantage of this invention is that partially oriented yarns of poly(trimethylene terephthalate) can be spun on equipment previously used to spin partially oriented yarns of poly (ethylene terephthalate), so spin speeds are preferably up to about 4,000 m/m, more preferably up to about 3,500 m/m. Spinning speeds of about 3,200 m/m frequently used to spin partially oriented yarns of poly(trimethylene terephthalate) are preferred.

The invention is primarily discussed with typical 3 to 7 dpf filaments. Spin speeds for fine filaments are lower. For instance, poly(trimethylene terephthalate) multifilament yarns of fine filaments are presently spun at less than 2,000 m/m, whereas with the invention they can be spun at higher speeds, such as about 2,500 m/m or higher.

Partially oriented yarns are usually wound on a package, and can be used to make fabrics or further processed into other types of yarn, such as textured yarn. They can also be stored in a can prior to preparing fabrics or further processing, or can be used directly without forming a package or other storage.

Spun drawn yarn, also known as "fully drawn yarn", can also be prepared advantageously using the invention. The preferred steps of manufacturing spun drawn yarns including spinning, drawing, optionally and preferably annealing, optionally interlacing, and winding poly(trimethylene terephthalate) filaments are similar to those used for preparing poly(ethylene terephthalate) yarns.

One advantage of this invention is that the process can be carried out at higher speeds than when the polymers of this invention aren't used.

Another advantage of this invention is that spun drawn yarns can be prepared using higher draw ratios than with poly(trimethylene terephthalate) by itself. This can be done by using a lower spin speed than normal, and then drawing at previously used speeds. When carrying out this process, there are fewer breaks than previously encountered.

Preferably, prior to spinning the blend is heated to a temperature above the melting point of each the poly (trimethylene terephthalate) and styrene polymer, and extruding the blend through a spinneret and at a temperature of about 235 to about 295° C., preferably at least about 250° C. and up to about 290° C., most preferably up to about 270° C. Higher temperatures are useful with short residence time.

These yarns are also multifilament yarns. The yarns (also known as "bundles") preferably comprise at least about 10 and even more preferably at least about 25 filaments, and typically can contain up to about 150 or more, preferably up to about 100, more preferably up to about 80 filaments. Yams containing 34, 48, 68 or 72 filaments are common. The yarns typically have a total denier of at least about 5, preferably at least about 20, preferably at least about 50, and up to about 1,500 or more, preferably up to about 250.

Filaments are preferably at least about 0.1 dpf, more preferably at least about 0.5 dpf, more preferably at least about 0.8 dpf, and up to about 10 or more dpf, more preferably up to about 5 dpf, and most preferably up to about 3 dpf.

The draw ratio is at least 1.01, preferably at least about 1.2 and more preferably at least about 1.3. The draw ratio is preferably up to about 5, more preferably up to about 3, and most preferably up to about 2.5.

Draw speeds (as measured at the roller at the end of the draw step) can run from about 2,000 or more m/m, and are preferably at least about 3,000 m/m, more preferably at least about 3,200 m/m, and preferably up to about 8,000 m/m, more preferably up to about 7,000 m/m.

Spun drawn yarns are usually wound on a package, and can be used to make fabrics or further processed into other types of yarn, such as textured yarn.

Textured yarns can be prepared from partially oriented yarns or spun drawn yarns. The main difference is that the partially oriented yarns usually require drawing whereas the spun drawn yarns are already drawn.

U.S. Pat. Nos. 6,287,688 and 6,333,106, and U.S. Patent Publication No. 2001/30378, all of which are incorporated herein by reference, describe the basic steps of manufacturing textured yarns from partially oriented yarns. This invention can be practiced using those steps or other steps conventionally used for making partially oriented polyester yarns. The basic steps include unwinding the yarns from a package, drawing, twisting, heat-setting, untwisting, and winding onto a package. Texturing imparts crimp by twisting, heat setting, and untwisting by the process commonly known as false twist texturing. The false-twist texturing is carefully controlled to avoid excessive yarn and filament breakage.

A preferred process for friction false-twisting described in U.S. Pat. Nos. 6,287,688 and 6,333,106, and U.S. Patent Publication No. 2001/30378 comprises heating the partially oriented yarn to a temperature between 140° C. and 220° C., twisting the yarn using a twist insertion device such that in the region between the twist insertion device and the entrance of the heater, the yarn has a twist angle of about 46° to 52° and winding the yarn on a winder.

When prepared from spun drawn yarn, the process is the same except that drawing is reduced to a very low level (e.g., draw ratio can be as low as 1.01).

These multifilament yarns (also known as "bundles") comprise the same number of filaments as the partially oriented yarns and spun drawn yarns from which they are made. Thus, they preferably comprise at least about 10 and even more preferably at least about 25 filaments, and typically can contain up to about 150 or more, preferably up to about 100, more preferably up to about 80 filaments. The yarns typically have a total denier of at least about 1, more preferably at least 20, preferably at least about 50, and up to about 1,500 or more, preferably up to about 250.

Filaments are preferably at least about 0.1 dpf, more preferably at least about 0.5 dpf, more preferably at least about 0.8 dpf, and up to about 10 or more dpf, more preferably up to about 5 dpf, and most preferably up to about 3 dpf.

When prepared from partially oriented yarn, the draw ratio is at least 1.01, preferably at least about 1.2 and more preferably at least about 1.3. The draw ratio is preferably up to about 5, more preferably up to about 3, and most preferably up to about 2.5. Draw speeds (as measured at the roller at the end of the draw step) can run from about 50 to about 1,200 or more m/m, and are preferably at least about 300 m/m and preferably up to about 1,000 m/m.

When prepared from spun drawn yarns, speeds (as measured at the first godet the fiber contacts) can run from about 50 to about 1,200 or more m/m, and are preferably at least about 300 m/m and preferably up to about 800 m/m.

A major advantage of this invention is that textured yarns can be prepared under the same or similar operating conditions to those used for partially oriented or spun drawn poly(trimethylene terephthalate) yarns prepared at slower conditions.

Poly(trimethylene terephthalate) bulked continuous filament ("BCF") yarns and their manufacture are described in U.S. Pat. No. 5,645,782 Howell et al., U.S. Pat. No. 6,109,015 Roark et al. and U.S. Pat. No. 6,113,825 Chuah; U.S. patent application Ser. Nos. 09/895,906 (published as U.S. 2003-0045611 A1), 09/708,209 (now U.S. Patent No. 6,576, 340), 09/938,760 (published as U.S. 2003-0083411 A1) and 10/099,373 (published as U.S. 2003-0175522 A1) (Attorney Docket Nos. CH2783, RD7850, CH2800, and CH2848, respectively); and WO 99/19557, all of which are incorporated herein by reference. BCF yarns are used to prepare all types of carpets, as well as textiles. The compositions of this invention can be used to improve the spin speed of their preparation.

Preferred steps involved in preparing bulked continuous filaments include spinning (e.g., extruding, cooling and coating (spin finish) the filaments), single stage or multi-stage drawing (preferably with heated rolls, heated pin or hot fluid assist (e.g., steam or air)) at about 80 to about 200° C. and at a draw ratio of about 3 to about 5, preferably at least about 3.4 and preferably up to about 4.5, annealing at a temperature of about 120 to about 200° C., bulking, entangling (which can be carried out in one step with bulking or in a subsequent separate step) optionally relaxing, and winding the filaments on a package for subsequent use.

Bulked continuous filament yarns can be made into carpets using well known techniques. Typically, a number of yarns are cable twisted together and heat set in a device such as an autoclave, Suessen or Superba®, and then tufted into a primary backing. Latex adhesive and a secondary backing are then applied.

A major advantage of this invention is that carpets can be prepared under the same or similar operating conditions to those used for poly(trimethylene terephthalate) bulked continuous filament yarns prepared at slower conditions.

Another advantage of the invention is that the draw ratio does not need to be lowered due to the use of a higher spinning speed. That is, poly(trimethylene terephthalate) orientation is normally increased when spinning speed is increased. With higher orientation, the draw ratio normally needs to be reduced. With this invention, the poly (trimethylene terephthalate) orientation is lowered as a result of using the styrene polymer, so the practitioner is not required to use a lower draw ratio.

Staple fibers and products can be prepared using the processes described in U.S. patent application Ser. Nos. 09/934,904 (published as U.S. 2002-0071951 A1) and 09/934,905 (published as U.S. 2002-0153641 A1), both filed Aug. 22, 2001, and WO 01/68962, WO 01/76923, WO 02/22925 and WO 02/22927, which are incorporated herein by reference. Poly(trimethylene dicarboxylate) staple fibers can be prepared by melt spinning the polytrimethylene dicarboxylate-styrene polymer blend at a temperature of about 245 to about 285° C. into filaments, quenching the filaments, drawing the quenched filaments, crimping the drawn filaments, and cutting the filaments into staple fibers, preferably having a length of about 0.2 to about 6 inches (about 0.5 to about 15 cm).

One preferred process comprises: (a) providing a polymer blend comprising poly(trimethylene dicarboxylate) and about 10 to about 0.1% styrene polymer, (b) melt spinning the melted blend at a temperature of about 245 to about 285° C. into filaments, (c) quenching the filaments, (d) drawing the quenched filaments, (e) crimping the drawn filaments using a mechanical crimper at a crimp level of about 8 to about 30 crimps per inch (about 3 to about 12 crimps/cm), (f) relaxing the crimped filaments at a temperature of about 50 to about 120° C., and (g) cutting the relaxed filaments into staple fibers, preferably having a length of about 0.2 to about 6 inches (about 0.5 to about 15 cm). In one preferred embodiment of this process, the drawn filaments are annealed at about 85 to about 115° C. before crimping. Preferably, annealing is carried out under tension using heated rollers. In another preferred embodiment, the drawn filaments are not annealed before crimping.

Staple fibers are useful in preparing textile yarns and textile or nonwoven fabrics, and can also be used for fiberfill applications and making carpets.

The invention can also be used to prepare monofilaments. Preferably monofilaments are 10 to 200 dpf. Monofilaments, monofilament yarns and use thereof are described in U.S. Pat. No. 5,340,909, EP 1 167 594 and WO 2001/75200, which are incorporated herein by reference. While the invention is primarily described with respect to multifilament yarns, it should be understood that the preferences described herein are applicable to monofilaments.

The filaments can be round or have other shapes, such as octalobal, delta, sunburst (also known as sol), scalloped oval, trilobal, tetra-channel (also known as quatra-channel), scalloped ribbon, ribbon, starburst, etc. They can be solid, hollow or multi-hollow.

While it is possible to prepare more than one type of yarn using a spinneret, the invention is preferably practiced by spinning one type of filament using a spinneret.

EXAMPLES

The following examples are presented for the purpose of illustrating the invention, and are not intended to be limiting. All parts, percentages, etc., are by weight unless otherwise indicated.

Intrinsic Viscosity

The intrinsic viscosity (IV) was determined using viscosity measured with a Viscotek Forced Flow Viscometer Y900 (Viscotek Corporation, Houston, Tex.) for the poly (trimethylene terephthalate) dissolved in 50/50 weight % trifluoroacetic acid/methylene chloride at a 0.4 grams/dL concentration at 19° C. following an automated method based on ASTM D 5225–92. These measured IV values were correlated to IV values measured manually in 60/40 weight % phenol/1,1,2,2-tetrachloroethane following ASTM D 4603–96.

Number Average Molecular Weight

The number average molecular weight of polystyrene was calculated according to ASTM D 5296–97. The same method was used for poly(trimethylene terephthalate) except that the calibration standard was a poly(ethylene terephthalate) of $M_W$~44,000 and hexafluoroisopropanol solvent.

Tenacity and Elongation at Break

The physical properties of the poly(trimethylene terephthalate) yarns reported in the following examples were measured using an Instron Corp. tensile tester, model no. 1122. More specifically, elongation to break, $E_b$, and tenacity were measured according to ASTM D-2256.

Leesona Skein Shrinkage Test

The well-known Leesona Skein Shrinkage test was used to measure bulk of the textured yarns. First, the number of wraps needed was determined by using the following formula:

$$\text{Number of wraps}=12{,}500\ \text{denier}/(\text{yarn denier}\times 2)$$

Then a skein was wound on a reel using the number of wraps determined from the above equation, and the circumference of the reel was measured for use in the final calculations. Then, a 20-gram weight of the skein was hung and the skein was removed from the reel. (The skein was not allowed to relax.) While the skein was still hung under the 20-gram tension, it was completely immersed in a container of water at 180° F. for 10 minutes. The skein was removed from the container of water (without removing the weight), and after two minutes the length of the skein was measured with the 20-gram weight still on. The skein shrinkage was calculated using the formula:

$$\text{Per cent Skein Shrinkage}=(LO-LF\times 100)/LO,$$

where LO=Original Length of skein (one-half circumference of the reel), and LF=Final Length with weight attached after hot treatment.

Polymer Blends

Polymer blends were prepared from Sorona® semi-dull ($TiO_2$=0.3%) poly(trimethylene terephthalate) (CP Polymer) pellets having an IV of 1.02 (available from E. I. DuPont de Nemours and Company, Wilmington, Del.) (poly (trimethylene terephthalate)) and the styrene polymers described in the following table:

TABLE 1

| | Polystyrene samples | | | | |
|---|---|---|---|---|---|
| Sample | Supplier | Polystyrene Grade | Melt Index (g/10 min) | Softening Point (° C.)[2] | No. Avg. Molecular Wt.[3] |
| A | BASF, Mount Olive, NJ | 168 MK G2 | 1.5[1] | 109 | 124,000 |
| B | Sigma-Aldrich, Saint Louis, Missouri | 44,114-7 | 3.4[1] | 99 | 95,000 |
| C | Sigma-Aldrich | 43,010-2 | 7.5[1] | 107 | 83,000 |
| D | Sigma-Aldrich | 43,011-0 | 14[1] | 101 | 86,000 |
| E | BASF | 145 DK G2 | 14[1] | 96 | 84,000 |
| F | A&M Styrene Co., Japan | 475 D | 2.0[4] | 102 | 84,000 |

[1]ASTM 1238, 200° C./5 kg.
[2]ASTM-D1525.
[3]Measured as described above.
[4]ISO-R1133.

Samples A to E had a density of 1.04 g/mL, and the density of sample F was 1.05 g/mL.

All of the polystyrene samples were polystyrene homopolymers except for sample F, which was a high impact polystyrene containing polybutadiene as a rubber component in an amount of 8–10 weight %.

The following procedures were used:

Procedure A.

Poly(trimethylene terephthalate) pellets were compounded with polystyrene using a conventional screw remelting compounder with a barrel diameter of 30 millimeters (mm) and a MJM-4 screw (Werner & Pfleiderer Corp., Ramsey, N.J.). The extrusion die was 3/16 inches (4.76 mm) in diameter with a screen filter at the die entrance.

The poly(trimethylene terephthalate) pellets were fed into the screw throat using a K-tron 5200 feeder (K-Tron International, Inc., Pitman, N.J.) with a 15 mm hollow auger and 25 mm tube. The nominal base polymer feed rate was dependent on the weight % used.

The polystyrene (PS) pellets (see Table 1) were also fed into the screw throat using a K-tron T-20 feeder with twin P1 screws. Only one spiral feeder screw was used. A vacuum was typically applied at the extruder throat.

The barrel sections of the compounder were held at the following temperatures. The first heated barrel section was turned off. The second and third sections were set at 170° C. The remaining eleven sections were set at 200° C. The screw was set at 225 revolutions per minute ("rpm") yielding a melt temperature of 250° C. at the extrusion die.

The extrudant flowed into a water bath to solidify the compounded polymer into a monofilament. Then two sets of air knives dewatered the filament before entering a cutter that sliced the filament into 2 mm length pellets.

Procedure B.

Salt and pepper blends were prepared from poly (trimethylene terephthalate) and polystyrene pellets by preparing a mixture of pellets and melting them. They were not compounded.

Procedure C.

The pellets from procedure A and B (or poly(trimethylene terephthalate) pellets in the control examples) were placed in a vacuum oven for drying for a minimum of 16 hours at 120° C. The dried pellets were removed from the oven and quickly dropped into a nitrogen blanketed supply hopper that was maintained at room temperature. The pellets were fed to a twin screw remelter at 100 grams per minute (gpm). The barrel heating sections were set to 240° C. for zone 1, 265° C. for zones 2 to 5, 268° C. for zones 7–8. Pump block was 268° C., pack box heater was 268° C.

Example 1

Partially Oriented Yarn Preparation

Partially oriented yarns were spun using conventional spinning techniques from poly(trimethylene terephthalate) blended according to Procedure A with polystyrene A described in Table 1 or by itself.

Poly(trimethylene terephthalate) or poly(trimethylene terephthalate)/styrene polymer blend prepared using Procedures A and C was extruded through a sand filter spin pack and a 34 round hole spinneret (0.012 inch (0.3 mm) diameter and 0.022 inch (0.56 mm) capillary depth holes) maintained at 273° C. The filamentary streams leaving the spinneret were quenched with air at 21° C., converged to a bundle and spin finish applied. Forwarding rolls with a subsurface speed described in the table below delivered the yarn bundle to an interlace jet and then onto a windup running at the speed described in the table below.

The spinning conditions and properties of the resultant partially oriented yarns are described in Table 2.

TABLE 2

Spinning Conditions & Partially Oriented Yarn Properties

| Sample | PS[a] wt % | Spin Speed[b] | Windup Speed[c] | Denier | DPF | Tenacity[d] | Elongation[e] |
|---|---|---|---|---|---|---|---|
| A(control) | — | 2500 | 2510 | 214 | 6.3 | 2.21 | 106.2 |
| B(control) | — | 3000 | 3010 | 215 | 6.3 | 2.66 | 88.2 |
| C(control) | — | 3500 | 3510 | 224 | 6.6 | 2.72 | 73.7 |
| 1 | 2 | 2500 | 2510 | 211 | 6.2 | 1.54 | 195.8 |
| 2 | 2 | 3000 | 3010 | 211 | 6.2 | 1.82 | 143.4 |
| 3 | 2 | 3500 | 3510 | 225 | 6.6 | 2.00 | 118.0 |

[a]"PS" = polystyrene A, as described in Table 1. The weight percentage is based on the weight of the blend.
[b]Spinning Godet Speed, m/m.
[c]Winding Speed, m/m.
[d]Tenacity, g/d.
[e]Elongation to Break, %.

Prior to this invention, poly(trimethylene terephthalate) partially oriented yarns had to be spun at slow speeds (ca. 2,500 m/m) to be suitable for draw-texturing operations. The data in Table 2 shows that the partially oriented yarns of this invention are suitable for draw-texturing when prepared at significantly higher spinning speeds.

The three control samples show that with increased spinning and windup speed elongation to break drops and tenacity increases. Products made at higher speeds were not sufficiently suitable for draw-texturing operations. With addition of styrene polymer, the partially oriented yarns spun at higher speeds had properties suitable for draw-texturing operations. Most notably, the styrene polymer containing yarns spun at 3500 m/m had properties similar to the control yarns that were spun at 2500 m/m, so that they could be draw-textured under similar conditions. As a result, using the invention partially oriented yarns can be prepared at higher speeds and can be used for draw-texturing without significant modifications to the draw-texturing operation. In addition, the invention enables use of equipment designed for making poly(ethylene terephthalate) partially oriented yarns at the higher speeds it was designed for.

Example 2

Partially Oriented Yarn Preparation

Yarn was spun as described in Example 1 from the blends prepared according to procedure A (except the samples which were salt and pepper blends prepared according to Procedure B, as indicated by a footnote in the Table 3) to demonstrate that partially oriented yarns can be prepared with a variety of styrene polymers and under varied conditions.

TABLE 3

Spinning Conditions & Partially Oriented Yarn Properties

| Sample No. | PS (wt %) | PS | Spinning Godet Speed, m/m | Winding Speed, m/m | Yarn Denier | DPF | Tenacity (g/d) | $E_b$, % |
|---|---|---|---|---|---|---|---|---|
| A(control) | — | — | 2500 | 2535 | 211 | 6.2 | 2.11 | 97.8 |
| B(control) | — | — | 2500 | 2530 | 212 | 6.2 | 2.25 | 106.0 |
| C(control) | — | — | 2500 | 2550 | 211 | 6.2 | 2.35 | 109.2 |
| D(control) | — | — | 3500 | 3550 | 152 | 4.5 | 3.10 | 70.7 |
| 1 | 1.3 | A | 3000 | 3000 | 208 | 6.1 | 2.00 | 126.0 |
| 2 | 2 | A | 3000 | 3000 | 208 | 6.1 | 1.72 | 155.0 |
| 3 | 2 | A | 3500 | 3520 | 203 | 6.0 | 2.08 | 115.0 |
| 4* | 2 | A | 3000 | 3030 | 210 | 6.2 | 1.80 | 131.7 |
| 5 | 2 | B | 3000 | 2980 | 210 | 6.2 | 2.17 | 117.0 |
| 6 | 2 | C | 3000 | 3030 | 204 | 6.0 | 2.19 | 106.1 |
| 7 | 2 | C | 3000 | 2980 | 215 | 6.3 | 2.14 | 113.0 |
| 8 | 2 | D | 3000 | 2980 | 204 | 6.0 | 2.30 | 108.0 |
| 9 | 2 | E | 3500 | 3520 | 208 | 6.1 | 2.56 | 86.4 |
| 10* | 1 | F | 3500 | 3550 | 147 | 4.3 | 2.75 | 82.2 |
| 11* | 2 | F | 3500 | 3550 | 144 | 4.2 | 2.09 | 103.5 |

*Salt and pepper blend prepared by Procedure B.

The data in Table 3 shows that partially oriented yarns can be prepared with a variety of styrene polymers and under varied conditions.

Example 3

Draw-Texturing

This example shows that yarns produced according to the invention are useful in subsequent draw-texturing operations.

The draw-texturing conditions use a friction false-twist texturing process using an apparatus described in FIG. 5 of U.S. Pat. No. 6,287,688, which is incorporated herein by reference. Partially oriented yarns prepared as described in Example 2 were heated to a temperature of about 180° C. as they passed through the heater and cooled to a temperature below the glass transition temperature of poly(trimethylene terephthalate) as they passed over the cooling plate. Take-up speed was 500 m/m.

The remaining draw-texturing process conditions and the properties of the resulting draw-textured poly(trimethylene terephthalate) yarn are set forth in Table 4 below. In this Table, the draw ratio is given as the ratio of the speed of the draw roll to the speed of the feed roll.

TABLE 4

Texturing

| Sample No. | PS | PS wt % | Draw Ratio | Yarn Denier | DPF | Tenacity g/d | $E_b$, % | Leesona Shrinkage |
|---|---|---|---|---|---|---|---|---|
| A (Control) | — | — | 1.35 | 163 | 4.8 | 2.68 | 43.0 | 47.6 |
| B (Control) | — | — | 1.44 | 160 | 4.7 | 2.77 | 42.7 | 42.0 |
| 1 | A | 1.3 | 1.47 | 151 | 4.4 | 2.49 | 49.2 | 43.3 |
| 2 | A | 2 | 1.69 | 132 | 3.9 | 2.43 | 47.8 | 38.6 |
| 4 | A | 2 | 1.55 | 142 | 4.2 | 2.51 | 49.4 | 43.8 |
| 5 | B | 2 | 1.47 | 153 | 4.5 | 2.72 | 42.9 | 40.7 |
| 6 | C | 2 | 1.42 | 157 | 4.6 | 2.83 | 46.1 | 43.6 |
| 7 | C | 2 | 1.45 | 155 | 4.6 | 2.77 | 48.5 | 40.9 |
| 8 | D | 2 | 1.43 | 162 | 4.8 | 2.72 | 44.0 | 41.5 |

The data in Table 4 shows that textured yarns prepared from the partially oriented yarns prepared according to the invention have properties comparable to poly(trimethylene terephthalate) yarns prepared from the control samples. This data shows that it is possible to prepare textured yarns from the partially oriented yarns of this invention under similar conditions to those used with poly(trimethylene terephthalate) partially oriented yarns spun at lower speeds.

Example 4

Spun Drawn Yarn Preparation

Spun drawn yarns (SDY) 1–5 containing poly (trimethylene terephthalate) and 0.95 weight % polystyrene A and control yarns A–C with 100% poly(trimethylene terephthalate) were prepared according to Example 1. Temperature of the spinning (first) godet was 60° C. Temperature of the second (drawing) godet was 120° C. Windup was at room temperature. The draw speed, draw ratio and physical properties of the resulting drawn yarns, as measured on an Instron tensile tester, model 1122, are provided in Table 5, below.

TABLE 5

Spinning and Drawing

| Run | Draw Ratio | Spinning Godet speed, m/m | Drawing Godet speed, m/m | Winding speed, m/m | Denier | Tenacity g/d | $E_b$, % | Spinnability |
|---|---|---|---|---|---|---|---|---|
| A | 2.5 | 1200 | 3000 | 2858 | 76.50 | 4.19 | 31.16 | Good |
| B | 2.0 | 1750 | 3500 | 3305 | 76.50 | 4.28 | 31.90 | Good |
| C | 1.8 | 2222 | 4000 | 3753 | 77.85 | 4.44 | 30.70 | Good |
| D | 1.6 | 2812 | 4500 | — | — | — | — | Poor |
| E | 1.4 | 3571 | 5000 | — | — | — | — | Poor |
| 1 | 3.5 | 857 | 3000 | 2830 | 76.50 | 3.68 | 41.46 | Good |
| 2 | 3.3 | 1060 | 3500 | 3300 | 76.50 | 3.63 | 38.05 | Good |
| 3 | 3.2 | 1250 | 4000 | 3785 | 77.40 | 3.72 | 38.26 | Good |
| 4 | 3.0 | 1500 | 4500 | 4280 | 77.85 | 3.80 | 37.71 | Good |
| 5 | 2.8 | 1923 | 5000 | 4725 | 76.95 | 3.79 | 37.09 | Good |

The data in Table 5 shows that spun drawn yarns can not be prepared at high speeds using poly(trimethylene terephthalate) by itself. In contrast, spun drawn yarns containing 0.95 weight % styrene polymer had good spinnability even when drawn at high speed and high draw ratios.

Example 5

POY & Fabrics

Poly(trimethylene terephthalate) having an I. V. of 1.0 and 0.95 weight % of polystyrene A was spun using a conventional remelt single screw extrusion process and conventional polyester fiber melt-spinning (S-wrap) technology into partially oriented yarn (POY) by extruding through orifices (of about 0.25 mm diameter) of a spinneret maintained at a temperature such as required to give a polymer temperature of approximately 261° C. The spinning machine was 8-ended with 38.1 pounds per hour total positional throughput. The filamentary streams leaving the spinneret were quenched with air at 21° C., collected into bundles of 34 filaments, approximately 0.4 weight % of a spin finish was applied, and the filaments were interlaced and collected at about 3250 m/m as a 34-filament yarn for each end. Physical properties of the partially oriented yarn produced, as measured with an Instron Corp. tensile tester, model 1122 are given below:

| | |
|---|---|
| Feed Roll Speed, m/m | 3270 |
| Winding Speed, m/m | 3259 |
| Denier, g | 105 |
| Tenacity, g/d | 2.30 |
| Elongation, % | 124 |
| Dry Heat Shrinkage, % | 42.8 |
| BOS, % | 51.9 |

Yarns produced as described were drawn at a speed of 500 m/m on a Barmag AFK draw-texture machine equipped with a 2.5 meter contact heater with a draw ratio of about 1.51 and heater temperature of 180° C. Physical properties, as measured on an Instron tensile tester, model 1122 are given below:

| | |
|---|---|
| Denier, g | 74.0 |
| Tenacity, g/d | 2.90 |
| Elongation, % | 42.7 |
| Leesona Shrinkage, % | 45.2 |

Textured yarns as described were knitted on a Monarch Fukahara circular knitting machine with 28 needles per inch and 24 feed yarns at a tension of 4 to 6 grams and at a speed of 18 rpm. Greig fabrics were then scoured at 160° F., dyed at 212° F. and heatset at 302° F. Fabrics dyed with Intrasil Navy Blue HRS were uniform, soft and stretchy.

Example 6

Electron Micrograph

FIG. 1 is an electron micrograph of a thin section of a poly(trimethylene terephthalate)/2 weight % polystyrene A filament prepared in Example 2 (Sample 2 of Table 3). The partially oriented yarn filament was sectioned by ultramicrotomy in the direction normal the filament axis. Diamond knives were used to prepare sections of nominal thickness 90 nm, which were accumulated in a 90/10 water/acetone mixture. The sections were transferred to copper mesh specimen grids and allowed to dry. All grids were selectively stained (to render the polystyrene relatively darker than the surrounding poly(trimethylene terephthalate) matrix) before microscopic observation. The selective staining was accomplished by placing the grids on perforated glass trays in a covered dish containing $RuO_4$ vapor generated from the reaction of ruthenium (III) chloride and aqueous sodium hypochlorite (bleach.) After 2 hours of staining, the grids were removed. The image was obtained using a JEOL 2000FX Transmission Electron Microscope (TEM) (Jeol Limited, Tokyo, Japan) operated at 200 KV accelerating voltage and recorded using a Gatan digital camera. The image was recorded at 2500× magnification (10 micron scale bar). Lines or wrinkles seen in the images are artifacts from imperfections in the diamond knife edge used in sample preparation. The polystyrene appears as a dispersed dark phase in the poly(trimethylene terephthalate) matrix. The image shows the dark polystyrene phase is well dispersed in the poly(trimethylene terephthalate) polyester matrix.

Figure 2:
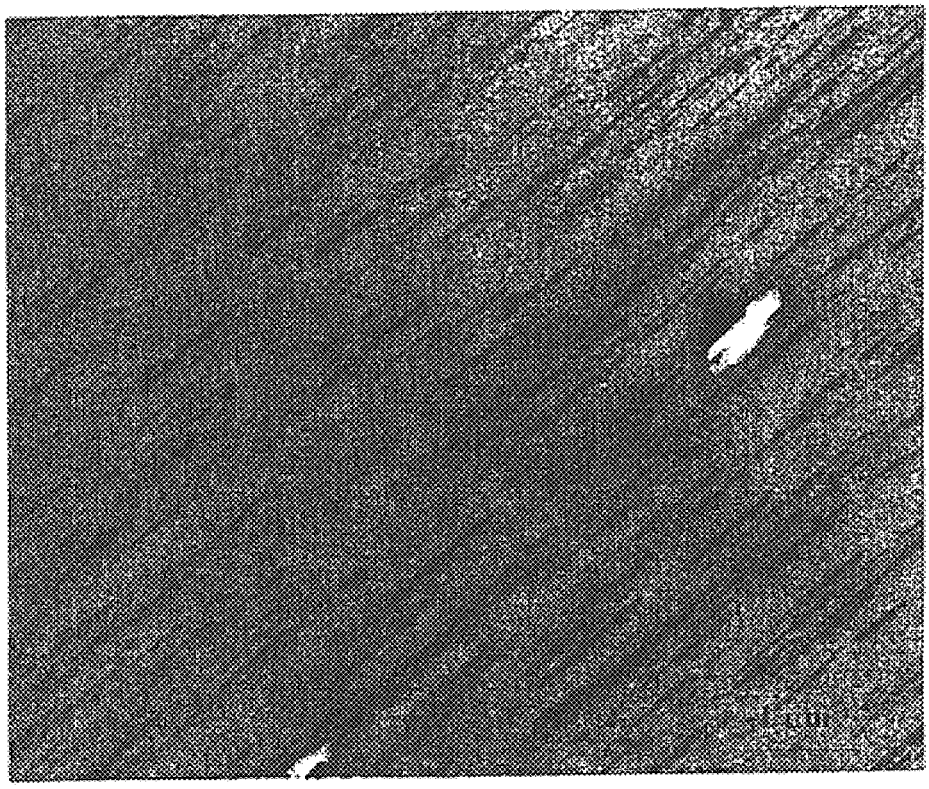
FIG. 2 is an electron micrograph showing a longitudinal image of a filament comprising poly(trimethylene terephthalate) and styrene polymer according to this invention.

FIG. 2 is an electron micrograph of a longitudinal section of the filament. This sample was also prepared for electron microscopy by the same method described above, although the section was microtomed parallel to the filament axis.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the disclosure.

What is claimed is:

1. A process for preparing poly(trimethylene dicarboxylate) multifilament yarn comprising (a) providing a polymer blend comprising poly(trimethylene dicarboxylate) and about 0.01 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly(trimethylene dicarboxylate) multiconstituent filaments containing styrene polymer dispersed throughout the filaments, wherein the multifilament yarn is partially oriented yarn, the spinning comprises extruding the polymer blend through a spinneret at a spinning speed of at least about 3,000 m/m, and wherein the processing comprises interlacing and winding the filaments.

2. The process of claim 1 wherein the poly(trimethylene dicarboxylate) is selected from the group consisting of poly(trimethylene arylate)s and mixtures thereof.

3. The process of claim 1 wherein the poly(trimethylene dicarboxylate) is poly(trimethylene terephthalate).

4. The process of claim 2 wherein the blend comprises about 90 to about 99.9 weight % of the poly(trimethylene arylate) and about 10 to about 0.1 weight % of the styrene polymer, by weight of the polymer in the polymer blend.

5. The process of claim 3 wherein the polymer blend comprises about 70 to about 99.9 weight % of the poly (trimethylene terephthalate), about 5 to about 0.5 weight % of the styrene polymer, by weight of the polymer in the polymer blend and, optionally, up to 29.5 weight % of other polyesters, by weight of polymer in the polymer blend.

6. The process of claim 1 wherein the blend comprises about 2 to about 0.5% styrene polymer, by weight of the polymer in the polymer blend.

7. The process of claim 3 wherein the blend comprises about 95 to about 99.5% of the poly(trimethylene terephthalate) and about 2 to about 0.5% of the styrene polymer, by weight of the polymer in the polymer blend.

8. The process of claim 3 wherein the multiconstituent filaments are poly(trimethylene terephthalate) biconstituent filaments comprised of about 98 to about 99.5% poly (trimethylene terephthalate) and about 2 to about 0.5% styrene polymer, by weight of the polymer in the filaments.

9. The process of claim 1 wherein the styrene polymer is selected from the group consisting of polystyrene, alkyl or aryl substituted polystyrenes and styrene multicomponent polymers.

10. The process of claim 9 wherein the styrene polymer is selected from the group consisting of polystyrene, alkyl or aryl substituted polystyrenes prepared from α-methylstyrene, p-methoxystyrene, vinyltoluene, halostyrene and dihalostyrene, styrene-butadiene copolymers and blends, styrene-acrylonitrile copolymers and blends, styrene-acrylonitrile-butadiene terpolymers and blends, styrene-butadiene-styrene terpolymers and blends, styrene-isoprene copolymers, terpolymers and blends, and blends and mixtures thereof.

11. The process of claim 10 wherein the styrene polymer is selected from the group consisting of polystyrene, methyl, ethyl, propyl, methoxy, ethoxy, propoxy and chloro-substituted polystyrene, or styrene-butadiene copolymer, and blends and mixtures thereof.

12. The process of claim 7 wherein the styrene polymer is selected from the group consisting of polystyrene, α-methyl-polystyrene, and styrene-butadiene copolymers and blends thereof.

13. The process of claim 1 wherein the styrene polymer is polystyrene.

14. The process of claim 7 wherein the styrene polymer is polystyrene.

15. A process for preparing poly(trimethylene dicarboxylate) multifilament yarn comprising (a) providing a polymer blend comprising about 70 to about 99.9 weight % poly(trimethylene dicarboxylate), optionally up to 29.5 weight % of other polyesters, and about 0.5 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly (trimethylene dicarboxylate) multiconstituent filaments containing styrene polymer substantially uniformly dispersed throughout the filaments, where the styrene polymer number average molecular weight is at least about 50,000.

16. The process of claim 2 where the styrene polymer number average molecular weight is at least about 75,000.

17. The process of claim 2 where the styrene polymer number average molecular weight is at least about 100,000.

18. The process of claim 2 where the styrene polymer number average molecular weight is at least about 120,000.

19. The process of claim 13 where the styrene polymer number average molecular weight is about 50,000 to about 300,000.

20. The process of claim 14 where the styrene polymer number average molecular weight is about 75,000 to about 200,000.

21. The process of claim 1 wherein the blend further comprises at least one selected from the group consisting of hexamethylene diamine, polyamides, delusterants, nucleating agents, heat stabilizers, viscosity boosters, optical brighteners, pigments, and antioxidants.

22. A process for preparing poly(trimethylene dicarboxylate) multifilament yarn comprising (a) providing a polymer blend comprising poly(trimethylene dicarboxylate) and about 0.01 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly(trimethylene dicarboxylate) multiconstituent filaments containing styrene polymer dispersed throughout the filaments, wherein the multifilament yarns comprise about 0.5 to about 2.5 dpf filaments, the multifilament yarn is partially oriented yarn, the spinning comprises extruding the polymer blend through a spinner at a spinning speed of at least about 2,500 m/m, and wherein the processing comprises interlacing and winding the filaments.

23. A process for preparing spun drawn poly(trimethylene dicarboxylate) multifilament yarn comprising (a) providing a polymer blend comprising poly(trimethylene dicarboxylate) and about 0.01 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) spun drawn poly(trimethylene terephthalate) multifilament yarn comprising poly(trimethylene dicarboxylate) multiconstituent filaments containing styrene polymer dispersed throughout the filaments, wherein the processing comprises drawing the filaments at a draw speed, as measured at the roller at the end of the draw step, of about 2,000 to about 8,000 m/m, annealing, interlacing and winding the filaments.

24. A process for preparing poly(trimethylene dicarboxylate) multifilament yarn comprising (a) providing a polymer blend comprising poly(trimethylene dicarboxylate) and about 0.01 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly(trimethylene dicarboxylate) multiconstituent filaments containing styrene polymer dispersed throughout the filaments, wherein the multifilament yarn is bulked continuous filament yarn.

25. The process of claim 24, wherein the processing comprises drawing, annealing, bulking, entangling (which can be carried out in one step with bulking or in a subsequent separate step), optionally relaxing, and winding the filaments.

26. A process for preparing poly(trimethylene dicarboxylate) multifilament yarn comprising (a) providing a polymer blend comprising poly(trimethylene dicarboxylate) and about 0.01 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly(trimethylene dicarboxylate) multiconstituent filaments containing styrene polymer dispersed throughout the filaments, wherein the process further comprises cutting the multifilament yarn into staple fibers.

27. A process for preparing poly(trimethylene terephthalate) multifilament textured yarn comprising poly (trimethylene terephthalate) multiconstituent filaments, comprising (a) preparing a package of partially oriented poly(trimethylene terephthalate) multifilament yarn by the process of claim 1, (b) unwinding the yarn from the package, (c) drawing the multiconstituent filaments yarn to form a drawn yarn, (d) false-twist texturing the drawn yarn to form the textured yarn, and (e) winding the yarn onto a package.

28. A process for preparing poly(trimethylene terephthalate) multifilament textured yarn comprising poly (trimethylene terephthalate) multiconstituent filaments, comprising (a) preparing a package of spun drawn poly (trimethylene terephthalate) multifilament yarn by the process of claim 23, (b) unwinding the yarn from the package, (c) false-twist texturing the yarn to form the textured yarn, and (d) winding the textured yarn onto a package.

29. A process for preparing poly(trimethylene dicarboxylate) multifilament yarn comprising (a) providing a polymer blend comprising about 70 to about 99.9 weight % poly(trimethylene dicarboxylate), optionally up to 29.5 weight % of other polyesters, and about 0.5 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn comprising poly (trimethylene dicarboxylate) multiconstituent filaments containing styrene polymer substantially uniformly dispersed throughout the filaments, wherein the dispersed styrene polymer has a mean cross-sectional size of less than about 1,000 nm.

30. The process of claim 29 wherein the dispersed styrene polymer has a mean cross-sectional size of less than about 500 nm.

31. The process of claim 29 wherein the dispersed styrene polymer has a mean cross-sectional size of less than about 200 nm.

32. The process of claim 29 wherein the dispersed styrene polymer has a mean cross-sectional size of less than about 100 nm.

33. The process of claim 29 wherein the styrene polymer is highly dispersed throughout the filaments.

34. The process of claim 5 wherein the styrene polymer is substantially uniformly dispersed throughout the filaments.

35. A process for preparing a poly(trimethylene dicarboxylate) monofilament comprising (a) providing a polymer blend comprising poly(trimethylene dicarboxylate) and about 0.01 to about 10 weight % styrene polymer, by weight of the polymer in the polymer blend, (b) spinning the polymer blend to form poly(trimethylene dicarboxylate) monofilament containing dispersed styrene polymer, and (c) processing the filament into 10 to 200 dpf poly(trimethylene dicarboxylate) multiconstituent monofilament comprising poly(trimethylene dicarboxylate) styrene polymer dispersed throughout.

36. A process for preparing poly(trimethylene dicarboxylate) multifilament yarn, comprising spinning at a speed of at least 3,000 m/m and processing a blend comprising poly(trimethylene dicarboxylate) and about 0.1 to about 10 weight % of another polymer, by weight of the polymers in the polymer blend, to form poly(trimethylene dicarboxylate) multifilament yarn, wherein the poly (trimethylene dicarboxylate) multifilament yarn has an elongation and tenacity within 20% of the elongation and tenacity of a poly(trimethylene dicarboxylate) multifilament yarn that only differs from the poly(trimethylene dicarboxylate) multifilament yarn in that it does not contain the other polymer and which is prepared in the same manner except that it is spun at a speed of 2,500 m/m and processed at speeds corresponding to that spinning speed.

37. A process for preparing poly(trimethylene dicarboxylate) multifilament yarn comprising (a) providing a polymer blend comprising about 90 to about 99.9 weight % poly(trimethylene dicarboxylate) and about 0.01 to about 10 weight % styrene polymer, by weight of the polymer in the polymer blend, (b) spinning the polymer blend to form poly(trimethylene dicarboxylate) multiconstituent filaments containing dispersed styrene polymer, and (c) processing the multiconstituent filaments into poly(trimethylene dicarboxylate) multifilament yarn consisting essentially of poly(trimethylene dicarboxylate) multiconstituent filaments containing styrene polymer substantially uniformly dispersed throughout the filaments.

38. The process of claim 37 wherein the styrene polymer is selected from the group consisting of polystyrene, alkyl or aryl substituted polystyrenes and styrene multicomponent polymers, the styrene polymer number average molecular weight is about 50,000 to about 300,000.

39. The process of claim 38 wherein the blend comprises about 95 to about 99.5% of the poly(trimethylene terephthalate) and about 2 to about 0.5% of the styrene polymer, by weight of the polymer in the polymer blend, the styrene polymer is polystyrene, the styrene polymer number average molecular weight is about 75,000 to about 200,000, and the blend further comprises at least one selected from the group consisting of hexamethylene diamine, polyamides, delusterants, nucleating agents, heat stabilizers, viscosity boosters, optical brighteners, pigments, and antioxidants.

40. The process of claim 23 wherein the blend comprises about 95 to about 99.5% of the poly(trimethylene terephthalate) and about 5 to about 0.5% of the styrene polymer, by weight of the polymer in the polymer blend, the styrene polymer is polystyrene, the styrene polymer number average molecular weight is about 50,000 to about 300,000.

41. The process of claim 40 wherein the dispersed styrene polymer has a mean cross-sectional size of less than about 500 nm.

42. The process of claim 25 wherein the blend comprises about 95 to about 99.5% of the poly(trimethylene terephthalate) and about 5 to about 0.5% of the styrene polymer, by weight of the polymer in the polymer blend, the styrene polymer is polystyrene, the styrene polymer number average molecular weight is about 50,000 to about 300,000.

43. The process of claim 42 wherein the dispersed styrene polymer has a mean cross-sectional size of less than about 500 nm.

44. The process of claim 26 wherein the blend comprises about 95 to about 99.5% of the poly(trimethylene terephthalate) and about 5 to about 0.5% of the styrene polymer, by weight of the polymer in the polymer blend, the styrene polymer is polystyrene, the styrene polymer number average molecular weight is about 50,000 to about 300,000.

45. The process of claim 44 wherein the dispersed styrene polymer has a mean cross-sectional size of less than about 500 nm.

46. The process of claim 29 wherein the blend comprises about 95 to about 99.5% of the poly(trimethylene terephthalate) and about 5 to about 0.5% of the styrene polymer, by weight of the polymer in the polymer blend, the styrene polymer is polystyrene, the styrene polymer number average molecular weight is about 50,000 to about 300,000.

47. The process of claim 36 wherein the blend comprises about 95 to about 99.5% of the poly(trimethylene terephthalate) and about 5 to about 0.5% of the styrene polymer, by weight of the polymer in the polymer blend, the styrene polymer is polystyrene, the styrene polymer number average molecular weight is about 50,000 to about 300,000.

48. The process of claim 47 wherein the dispersed styrene polymer has a mean cross-sectional size of less than about 500 nm.

49. The process of claim 38 wherein the dispersed styrene polymer has a mean cross-sectional size of less than about 500 nm.

50. The process of claim 36 wherein the poly (trimethylene dicarboxylate) is poly(trimethylene terephthalate), the another polymer is styrene polymer, the blend comprises about 95 to about 99.5% of the poly (trimethylene terephthalate) and about 5 to about 0.5 of the styrene polymer, by weight of the polymer in the polymer blend, the styrene polymer is polystyrene, the styrene polymer number average molecular weight is about 50,000 to about 300,000, and the styrene polymer is substantially uniformly dispersed throughout the filaments.

51. The process of claim 1 wherein the poly(trimethylene dicarboxylate) is poly(trimethylene terephthalate), the another polymer is styrene polymer, the blend comprises about 95 to about 99.5% of the poly(trimethylene terephthalate) and about 5 to about 0.5% of the styrene polymer, by weight of the polymer in the polymer blend, the styrene polymer is polystyrene, the styrene polymer number average molecular weight is about 50,000 to about 300,000, and the styrene polymer is substantially uniformly dispersed throughout the filaments.

* * * * *

UNITED STATES PATENT AND TRADEMARK OFFICE

CERTIFICATE OF CORRECTION

PATENT NO. : 6,923,925 B2 
APPLICATION NO. : 10/183710
DATED : August 2, 2005
INVENTOR(S) : Chang Jing C., Kurian Joseph V. and Subramoney Shekhar It is certified that error appears in the above-identified patent and that said Letters Patent is hereby corrected as shown below:

In column 25, line 56, in claim 22, "through a spinner at" should read --through a spinneret at--

Signed and Sealed this

Eighth Day of August, 2006

JON W. DUDAS
*Director of the United States Patent and Trademark Office*